US006182623B1

(12) United States Patent
Sugie et al.

(10) Patent No.: US 6,182,623 B1
(45) Date of Patent: Feb. 6, 2001

(54) VARIABLE VALVE CONTROL DEVICE

(75) Inventors: Nobuhiko Sugie, Tokoname; Jouji Yamaguchi, Kariya; Osamu Sato, Takahama; Yoshihito Moriya, Nagoya; Shinichiro Kikuoka, Nishikamo-gun; Noriyuki Iden, Toyota, all of (JP)

(73) Assignee: Denso Corporation, Kariya (JP)

( * ) Notice: Under 35 U.S.C. 154(b), the term of this patent shall be extended for 0 days.

(21) Appl. No.: 09/453,708

(22) Filed: Dec. 3, 1999

(30) Foreign Application Priority Data

Dec. 9, 1998 (JP) ..... 10-349856

(51) Int. Cl.[7] ..... F01L 13/00; F01L 1/34

(52) U.S. Cl. ..... 123/90.17; 123/90.18; 123/90.31

(58) Field of Search ..... 123/90.15, 90.17, 123/90.18, 90.31

(56) References Cited

U.S. PATENT DOCUMENTS 5,893,345 * 4/1999 Sugimoto et al. ..... 123/90.17
5,924,397 * 7/1999 Moriya et al. ..... 123/90.18
6,014,952 * 1/2000 Sato et al. ..... 123/90.17

FOREIGN PATENT DOCUMENTS 9-32519 4/1997 (JP) .
10-30413 3/1998 (JP) .

OTHER PUBLICATIONS

Titolo, "The Variable Valve Timing System–Application on a V8 Engine", 1991 Winner of the Charles Deutsch Prize.

* cited by examiner

*Primary Examiner*—Weilun Lo
(74) *Attorney, Agent, or Firm*—Nixon & Vanderhye, P.C.

(57) ABSTRACT

In a variable valve control device, the minimum operating hydraulic pressure necessary for controlling the vane rotor is arranged to be higher than that for axially moving the piston member. Thus, whenever the angular phase is actually changed, the hydraulic pressure sufficient enough to move the piston member may be always ready to be applied to the axial movement control member. Therefore, when the intake camshaft is at the lowest lift stroke position, the intake camshaft may be easily shifted from the lowest lift stroke position to the higher lift stroke position without time delay so that a highly accurate angular phase control of the intake camshaft relative to the timing pulley may be secured.

4 Claims, 4 Drawing Sheets

VARIABLE VALVE CONTROL DEVICE

CROSS REFERENCE TO RELATED APPLICATION

This application is based upon and claims priority from Japanese Patent Application No. Hei 10-349856 filed Dec. 9, 1998, the contents of which are incorporated herein by reference.

BACKGROUND OF THE INVENTION

1. Field of the Invention

The present invention relates to a variable valve control device for changing opening/closing timing and lift stroke of at least one of an intake valve and an exhaust valve for an internal combustion engine (hereinafter referred to simply as an "engine") according to engine operating conditions.

2. Description of Related Art

There has been known a vane type variable valve control device for controlling opening/closing timing of at least one of the intake and exhaust valves in a manner that a camshaft is driven via a timing pulley or a chain sprocket which rotates in synchronism with an engine crank shaft with a phase difference by relative rotation between the timing pulley or the chain sprocket and the camshaft. Such a variable valve control device is operative for changing a mutually overlapping valve-open period of the intake and exhaust valves to secure more stable engine operation, less fuel consumption and lower exhaust emission.

Further, as disclosed in JP-A-9-32519, there is also a known variable valve control device in which the valve-open period and the lift stroke of at least one of the intake valve and the exhaust valve are changed by axially moving a camshaft provided with a cam having an axially different profile.

Furthermore, according to the variable valve control device shown in JP-A-9-32519, the valve-open period and the lift stroke is changed by controlling the pressure to a hydraulic actuator according to engine operating conditions so that more stable engine operation, less fuel consumption and lower exhaust emission may be further secured.

However, the conventional variable valve control device, in which phase control means for adjusting the angular phase of the camshaft relative to the crankshaft and axial movement control means for changing the valve-open period and the lift stroke of one of the intake and exhaust valves are combined and controlled independently of each other, has the following problems.

At first, in the cam having an axially different profile, a camshaft receives a thrust force acting toward a lower lift stroke position due to an axially tapered cam profile. When a movable piston as a hydraulic actuator is held at the lowest lift stroke position, the movable piston is in contact with and is pushed onto an axial end surface of a pressure chamber at the lowest lift stroke position by the thrust force. Therefore, a responsiveness of the angular phase control is adversely affected by a friction between the piston and the axial end surface.

Secondly, when the movable piston is held at the highest lift stroke position by supplying sufficient oil to a high lift side pressure chamber, the movable piston is in contact with and is pushed onto the other axial end surface restricting the cam shaft stroke. Thus, a friction between the piston and the other axial end surface causes a worse responsiveness of the angular phase control.

Thirdly, when the movable piston is at the lowest lift stroke position and air is invaded into the high lift side pressure chamber or when the movable piston is at the highest lift stroke position and air is invaded into the low lift side pressure chamber, a responsiveness of shifting the movable piston from the lowest lift stroke position toward the higher lift stroke position or from the highest lift stroke position toward the lower lift stroke position is adversely affected.

SUMMARY OF THE INVENTION

The present invention is made in light of the foregoing problems, and it is an object of the present invention to provide a variable valve control device having a better control responsiveness for changing the angular phase.

Another object of the present invention is to provide a variable valve control device having a better control responsiveness for changing the valve-open period and the lift stroke.

To achieve the above objects, in the variable valve control device, a rotatable and axially movable driven shaft (camshaft) is provided with a cam having axially and radially different profile for opening and closing an intake or exhaust valve. the cam is rotated by angular phase control means for hydraulically changing an angular phase of the driven shaft relative to a drive shaft (crankshaft) to adjust opening/closing timing of the valve. Further, the cam is axially moved by axial movement control means for hydraulically controlling an axial movement of the driven shaft to adjust a valve-open period and a lift stroke of the valve.

The angular phase control means and the axial movement control means are operative independently of each other. Therefore, the valve-opening/closing timing, the valve-open period and the lift stroke of at least one of the intake and exhaust valves are optimally controlled according to engine operating conditions so that more stable engine operation, lower fuel consumption and less exhaust emission may be secured.

In the above device, the axial movement control means have a pressure chamber and a piston fixed with the driven shaft and axially moving in the pressure chamber. It is arranged in such a manner that pressure more than minimum operating pressure necessary for axially moving the piston is always ready to be applied to the axial movement control means at the time when the angular phase control means actually changes the angular phase of the driven shaft relative to the drive shaft. In particular, in case that a pump supplies hydraulic pressure to both the axial movement control means and the angular phase control means, the axial movement control means and the angular phase control means are constructed, preferably, to have a feature that the minimum operating hydraulic pressure to the angular phase control means necessary for changing the angular phase of the driven shaft is higher than that to the axial movement control means for axially moving the piston.

As a result, whenever the angular phase is actually changed, the hydraulic pressure sufficient enough to move the piston may be always ready to be applied to the axial movement member. Therefore, when the driven shaft is at the lowest lift stroke position, the driven shaft may be easily shifted via the piston from the lowest lift stroke position to the higher lift stroke position without time delay so that a highly accurate angular phase control of the driven shaft may be secured, while a better responsiveness of the angular phase control of the driven shaft may be also assured.

Further, even when the driven shaft is at the lowest lift stroke position or at the highest lift stroke position, at least the high lift side pressure chamber or the low lift side pressure chamber is hydraulically controlled to the extent that the driven shaft can not be moved from the lowest lift position to the higher lift stroke position or from the highest lift stroke position to the lower lift stroke position. Preferably, when the driven shaft is at the lowest lift stroke position, the hydraulic pressure is applied to the piston in a manner that a force almost equal to and slightly less than a thrust force of the driven shaft is given to the piston so as to act in a direction of moving the driven shaft toward the higher lift stroke position.

As at least the high lift side pressure chamber or the low lift side pressure chamber is hydraulically controlled as mentioned above, the friction between the piston and the stopper is less or, preferably, is none so that the interference between the angular phase control and the axial movement control may be minimized, thus resulting in the better responsiveness of the angular phase control.

Further, as the hydraulic pressure difference necessary for axially shifting the piston from the lowest lift stroke position to the higher lift stroke position or from the highest lift stroke position to the lower lift stroke position is relatively small or, preferably, zero, a better responsiveness of the axial movement control may be secured.

Furthermore, as at least the high lift side pressure chamber or the low lift side pressure chamber is hydraulically controlled and filled with oil, air invasion into the high lift side pressure chamber or the low lift side pressure chamber can be prevented so that a much better responsiveness of the axial movement control may be secured.

BRIEF DESCRIPTION OF THE DRAWINGS

Other features and advantages of the present invention will be appreciated, as well as methods of operation and the function of the related parts, from a study of the following detailed description, the appended claims and the drawings, all of which form a part of this application. In the drawings:

DESCRIPTION OF PREFERRED EMBODIMENT

First Embodiment

Figure 1:
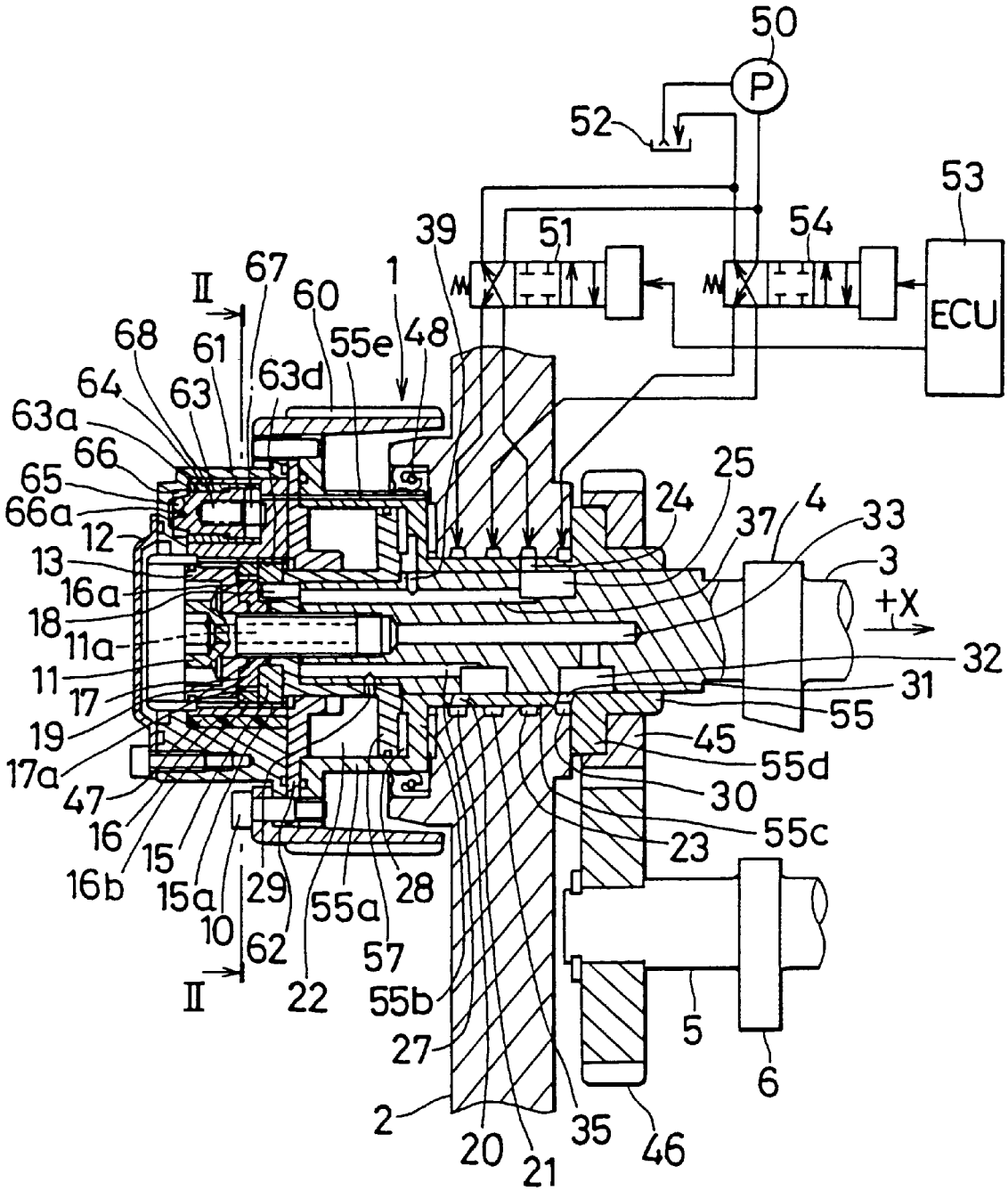
FIG. 1 is a cross sectional view of a variable valve control device according to a first embodiment of the present invention.
Figure 2:
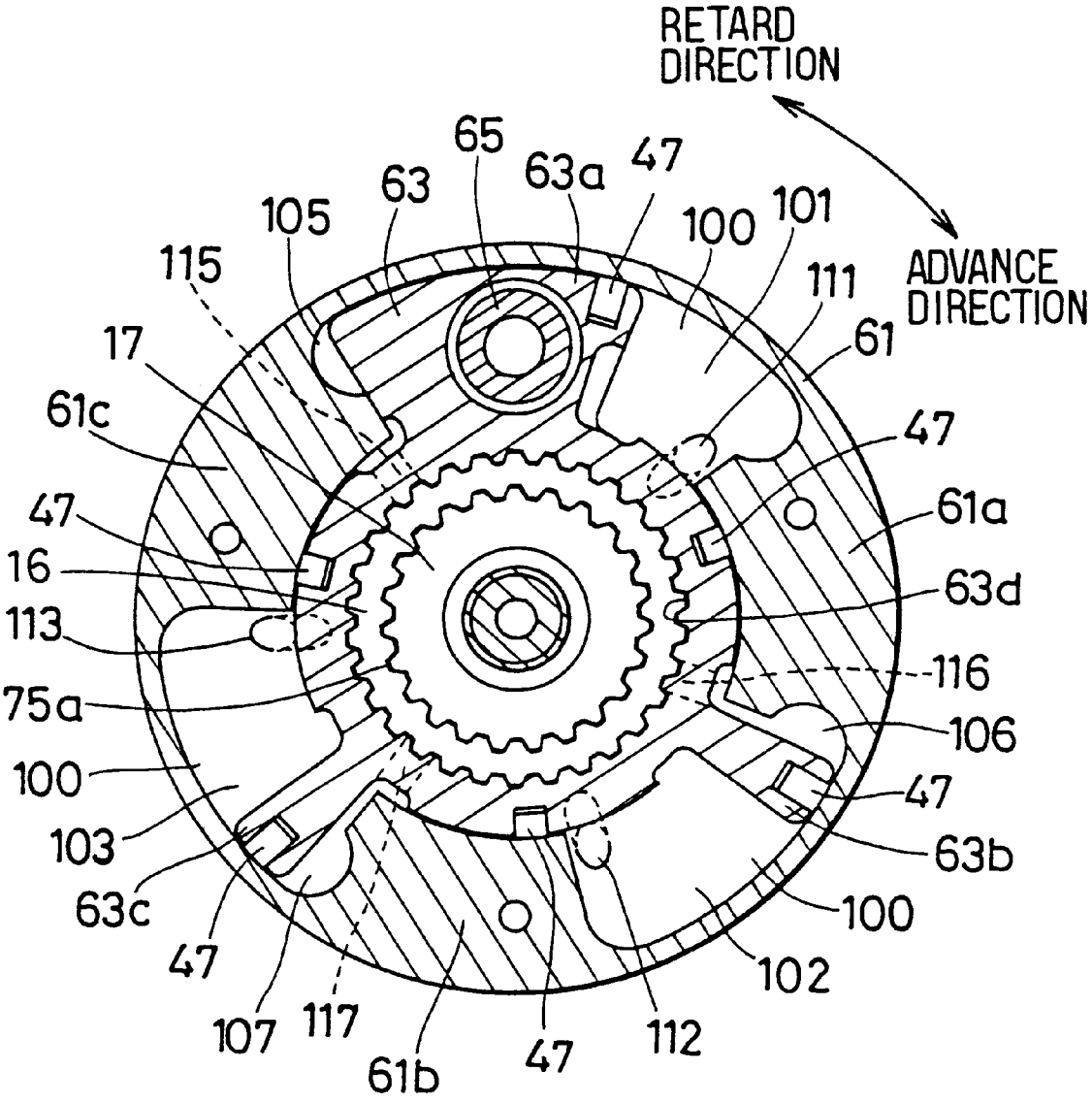
FIG. 2 is a cross sectional view taken along a line II—II in FIG. 1 according to the first embodiment of the present invention.

A first embodiment of a variable valve control device to which the present invention is applied is explained based on FIGS. 1, 2 and 3.

The variable valve control device 1 of the first embodiment is of a hydraulic control type and for transmitting the torque of a crankshaft (not shown) as a drive shaft to an intake camshaft 3 and an exhaust camshaft 5. The intake camshaft 3 corresponding to a driven shaft is movable in its axial direction. A multi-dimensional cam 4 for opening and closing the intake valve is mounted on the intake camshaft 3. The multi-dimensional cam 4 has a different profile in the axial and radial direction, and its left-hand side of FIG. 1 is for low speed rotations, that is, for low lift side whereas its right-hand side of FIG. 1 is for high speed rotations, that is, for high lift side. The exhaust camshaft 5 cannot move in its axial direction. A cam 6 for opening and closing the exhaust valve is mounted on the exhaust camshaft 5. The cam 6 has a uniform profile in the axial direction. In FIG. 1, the intake camshaft 3 is at a lowest lift stroke position.

A timing pulley 60 is connected to the crankshaft via a timing belt (not shown) so that the timing belt receives a torque from and rotates in synchronism with the crankshaft.

A cylindrical portion 55*a,* an annular portion 55*b,* a cylindrical portion 55*c* and an annular portion 55*d* are integrally formed as a rotary member 55. The rotary member 55 is rotatably supported by the cylinder head 2. The rotary member 55 supports the intake camshaft 3 in such a manner that the intake camshaft 3 rotates and axially moves relative to the rotary member 55. Since clearances between the cylinder head 2 and the annular portions 55*b* and 55*d* in the axial direction are only for allowing the rotational slide, the rotary member 55 cannot substantially move in its axial direction.

A not-shown bolt attaches a gear 45 to the rotary member 55. A gear 46 is attached to the exhaust camshaft 5. By bringing the gear 45 in mesh with the gear 46, the torque of the crankshaft is transmitted to the exhaust camshaft 5 with the same phase of the crankshaft through the timing pulley 60, the rotary member 55, the gear 45 and the gear 46.

A bolt 10 combines the timing pulley 60, the cylindrical portion 55*a,* a rear plate 62 and a later-described shoe housing 61. The timing pulley 60, the shoe housing 61, the rear plate 62 and the rotary member 55 constitutes a drive side rotor.

The intake camshaft 3 receives the torque from the timing pulley 60 and can rotate with a predetermined phase difference relative to the timing pulley 60. The timing pulley 60 and the intake camshaft 3 rotate clockwise, as viewed from the left-hand side of FIG. 1. This rotational direction will be called "advanced angular direction" and the opposite rotational direction will be called "retard angular direction".

A piston member 57 as axial moving means is installed radially between the rotary member 55 and the intake camshaft 3, and is fixed with the intake camshaft 3 in such a manner that the piston member 57 can neither rotate nor axially move relative to the intake camshaft 3. The piston member 57 divides the hydraulic pressure chamber, defined by the intake camshaft 3, the rotary member 55 and the rear plate 62, into a low lift side pressure chamber 22 and a high lift side pressure chamber 28. The axial movement of the piston member 57 or the intake camshaft 3 in a left-hand direction or in right-hand direction in FIG. 1 will be called the movement to higher lift stroke position or to lower lift stroke position. The piston member 57 and pressure chambers 22 and 28 constitute axial movement control means.

The shoe housing 61 together with the rear plate 62 constitutes a housing for housing a later-described vane rotor 63. The opening of the shoe housing 61 is closed by a cover 12. The shoe housing 61 and the vane rotor 63 constitute angular phase control means.

As shown in FIG. 2, the shoe housing 61 has shoes 61*a,* 61*b* and 61*c* which are formed substantially equidistantly each other in the circumferential direction to have an arc-shaped cross section respectively. In the three circumferential gaps among the shoes 61*a,* 61*b* and 61*c,* there are formed sector spaces 100 which act as pressure chambers for housing vanes 63*a,* 63*b* and 63*c* as vane members.

Both axial end surfaces of the vane rotor 63 acting as the driven side rotor are covered by the shoe housing 61 and the rear plate 62. The vane rotor 63 is equipped substantially equidistantly in the circumferential direction with the vanes 63*a,* 63*b* and 63*c,* which are rotatably housed in the sector spaces 100. Arrows in FIG. 2 indicating the retard direction and the advance direction represent the retarded angular direction and the advanced anglular direction of the vane rotor 63 relative to the shoe housing 61 respectively. In FIG. 2, each vane is positioned at one circumferential end portion of each sector space 100, and the vane rotor 63 is positioned at the most retarded position relative to the shoe housing 61. This most retarded position is defined by retaining the retard side face of the vane 63*a* on the advance side face of the shoe 61*c*. An internal spline 63*d* is formed on the inner circumferential wall of the vane rotor 63.

A positive spline member 15 and a negative spline member 16 shown in FIG. 1 are engaged with the vane rotor 63 so that the intake camshaft 3, the positive spline member 15 and the negative spline member 16 rotate together with the vane rotor 63 and are axially movable back and forth relative to the vane rotor 63.

The positive spline member 15, whose rotational position is determined by a pin 18, is mounted on the axial end face of the intake camshaft 3. The positive spline member 15 and a diametrically reduced member 17 are fixed to the intake camshaft 3 through a bushing 13 by a bolt 11 in such a manner that the positive spline member 15 and the diametrically reduced member 17 are inhibited from rotating relative to the intake camshaft 3.

Figure 3A:
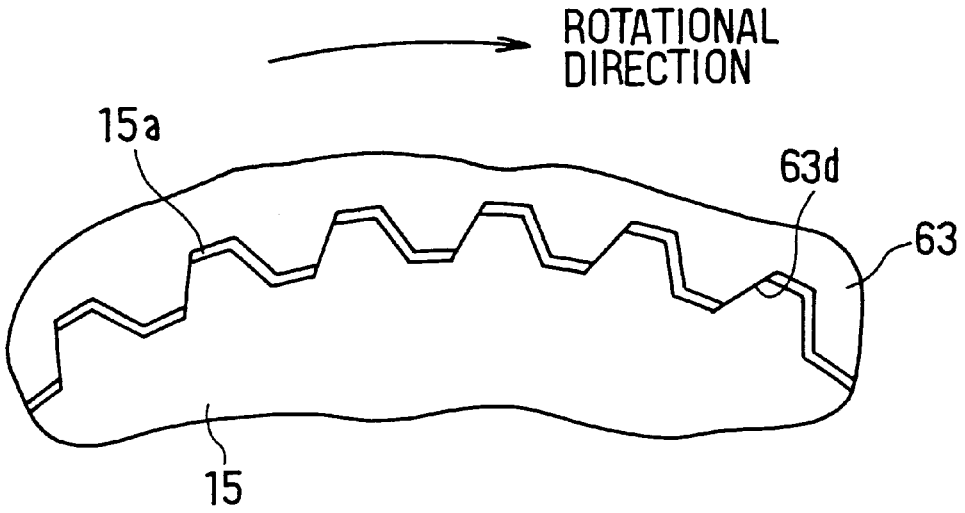
FIG. 3A is a view showing the spline engagement between a vane rotor and a positive spline member according to a first embodiment of the present invention.
Figure 3B:
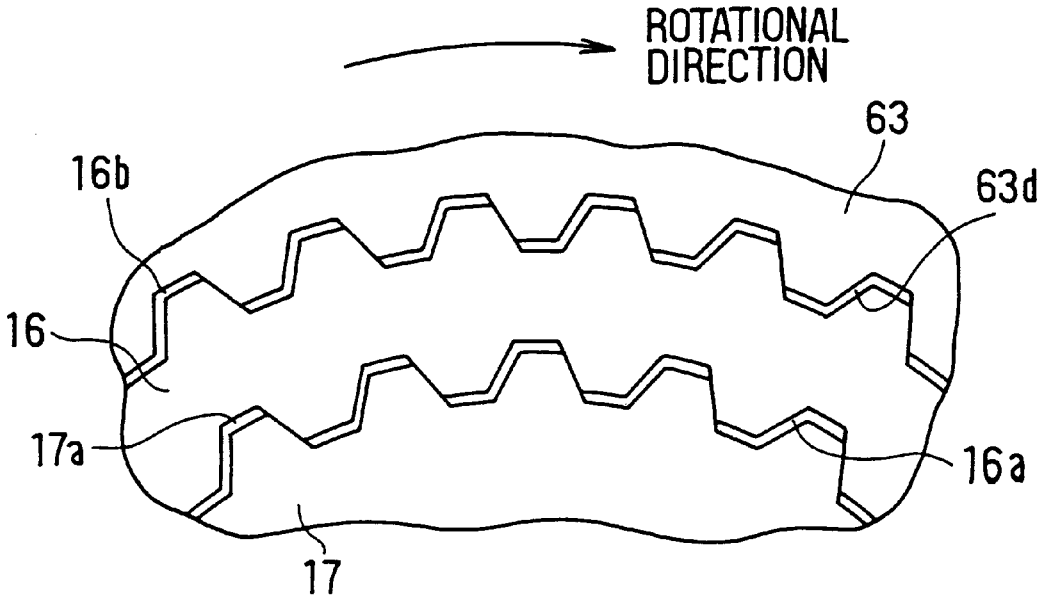
FIG. 3B is a view showing the spline engagement among a vane rotor, a negative spline member and a diametrically reduced member according to a first embodiment of the present invention.

As more clearly shown in FIGS. 3A and 3B, an external spline 15*a* is formed on the outer circumferential wall of the positive spline member 15. The diametrically reduced member 17 has a smaller external diameter than that of the positive spline member 15, and has an external helical spline 17*a* formed on its outer circumferential wall.

The negative spline member 16 has an internal helical spline 16*a* formed on its inner circumferential wall, and is engaged with the diametrically reduced member 17 via helical spline. On the other hand, the negative spline member 16 has an external spline 16*b* formed on the outer circumferential wall, and is engaged with the vane rotor 63 via spline. The negative spline member 16 is axially biased by a leaf spring 19 such that its internal helical spline 16*a* may contact against the external helical spline 17*a* of the diametrically reduced member 17 backward of the rotational direction.

By the biasing force of the leaf spring 19, the diametrically reduced member 17 and the positive spline member 15 are biased backward of the rotational direction, so that the external spline 15*a* of the positive spline member 15 contacts against the internal spline 63*d* of the vane rotor 63 backward of the rotational direction. The negative spline member 16 is caused to push the diametrically reduced member 17 backward of the rotational direction by the biasing force of the leaf spring 19 and is biased by itself forward of the rotational direction, so that the external spline 16*b* of the negative spline member 16 contacts against the internal spline 63*d* of the vane rotor 63 forward of the rotational direction.

In the first embodiment, the negative spline member 16 is engaged with the diametrically reduced member 17 via helical spline, and is axially biased by the leaf spring 19, so that the external spline of the positive spline member 15 and the negative spline member 16 contact against the internal spline 63*d* of the vane rotor 63 as the driven side rotor, respectively, while establishing no backlash by deviating the tooth traces backward and forward of the rotational direction. Even if the camshaft 3 receives the positive/negative torque fluctuations, therefore, the chattering noise, as might otherwise be caused by the collisions between the spline teeth, can be prevented at the engaged portions between the positive spline member 15 and the negative spline member 16 and the vane rotor 63.

As shown in FIG. 2, seal members 47 are fitted on the outer circumferential wall of the vane rotor 63. Small clearances are formed between the outer circumferential wall of the vane rotor 63 and the inner circumferential wall of the shoe housing 61, and seal members 47 are provided to prevent the working oil from leaking between the pressure chambers through those clearances. The seal members 47 are individually pushed onto the inner circumferential wall of the shoe housing 61 by the bias force of the leaf spring.

In the inner wall of the vane 63*a,* as shown in FIG. 1, there is press-fitted and retained a guide ring 64, into which a stopper piston 65 acting as a contact portion is inserted. This stopper piston 65 is formed into a cylindrical shape having a bottom, and is accommodated in the guide ring 64 such that the stopper piston 65 can slide in the axial direction of the intake camshaft 3. The stopper piston 65 is biased toward a later-described stopper bore 66*a* by a spring 67.

A fitted ring 66 is fitted in a fitting hole formed in the shoe housing 61, while having the stopper bore 66*a* in its inner circumferential wall. The stopper piston 65 can be fitted in the stopper bore 66*a* at the most retarded angular position. With the stopper piston 65 being fitted in the stopper bore 66*a* and contacting against it in the rotational direction, the rotation of the vane rotor 63 relative to the shoe housing 61 is restrained. In other words, the stopper piston 65 and the stopper bore 66*a* are holding each other at the most retarded angular position.

The stopper piston 65 receives the oil pressure from both the advance side and the retard side. The force, at the pressure receiving surface of the stopper piston 65, receiving from the working oil acts in the direction to disengage the stopper piston 65 from the stopper bore 66*a*. When an oil pressure equal to or higher than a predetermined level is applied to the stopper piston 65, this stopper piston 65 is disengaged from the stopper bore 66*a* against the bias force of the spring 67.

The stopper piston 65 and the stopper bore 66*a* are so positioned that the stopper piston 65 can be fitted in the stopper bore 66*a* by the bias force of the spring 67 when the vane rotor 63 is at the most retarded position relative to the shoe housing 61, that is, when the intake camshaft 3 is at the most retarded position relative to the crankshaft.

In the rear plate side of the vane 63*a* and in the rear plate 62, as shown in FIG. 1, there is formed a communication passage for providing the communication between a back pressure chamber 68 of the stopper piston 65 and an air vent passage 55*e* formed in the cylindrical portion 55*a*. The back pressure chamber 68 and the air vent passage 55*e* communicate with each other at the most retarded position. The air vent passage 55*e* is vented to the oil lubrication space of the engine via periphery of the oil seal 48. As a result, the back pressure chamber 68 is vented to the atmosphere at the most retard position, and the movement of the stopper piston 65 is not obstructed. When the vane rotor 63 rotates from the most retarded position toward the advance direction, that is, when the vane rotor 63 rotates to disengaged position at which the stopper piston 65 disengages from the stopper bore 66*a,* the communication between the back pressure chamber 68 and the air vent passage 55*e* is terminated.

As shown in FIG. 2, a retard side pressure chamber 101 is formed between the shoe 61*a* and the vane 63*a,* a retard side pressure chamber 102 is formed between the shoe 61*b* and the vane 63*b,* and a retard side pressure chamber 103 is formed between the shoe 61*c* and the vane 63*c*. On the other hand, an advance side pressure chamber 105 is formed between the shoe 61*d* and the vane 63*a,* an advance side pressure chamber 106 is formed between the shoe 61*a* and the vane 63*b,* and an advance side pressure chamber 107 is formed between the shoe 61*b* and the vane 63*c*. Each of the pressure chambers constitutes a drive side hydraulic pressure chamber.

As shown in FIG. 1, annular oil passages 20, 23, 30 and 35 are formed in the inner circumferential wall of the cylinder head 2. The oil passages 23 and 35 are formed between the oil passage 20 and the oil passage 30. These oil passages 20 and 23 can be connected to either of a hydraulic pump 50 acting as a drive source or a drain 52 via a switching valve 51. On the other hand, the oil passages 30 and 35 can be connected to either of the hydraulic pump 50 acting as the drive source or the drain 52 via a switching valve 54. The switching valves 51 and 54 can independently switch the oil passages in response to a command from the ECU 53.

Communication ports 21, 24 and 31 are formed in the cylindrical portion 55*c* of the rotary member 55. In the outer circumferential wall of the intake camshaft 3, there are formed oil pressure chambers 26, 25 and 32 that have arc-shaped transverse cross sections.

The oil passage 20 communicates with the low lift side pressure chamber 22 via the communication port 21, the oil pressure chamber 26 and oil passages 27 and 29 formed inside the intake camshaft 3. The oil passage 23 communicates with the high lift side pressure chamber 28 via the communication port 24, the oil pressure chamber 25, oil passages 37 and 39 formed in the intake camshaft 3.

When the cam 4 drives the intake valve, the intake camshaft 3 receives the thrust force rightward in FIG. 1, that is, in a +X direction shown by an arrow in FIG. 1, because of the tapered profile. When the piston member 57 is controlled to move axially against the thrust force, therefore, the high lift side pressure chamber 28 requires a higher hydraulic pressure than that of the low lift side pressure chamber 22 does. In other words, the oil pressure to be applied to the oil passage 23 is higher than that to the oil passage 20.

By controlling the switching valve 51 to change the connections between the oil passages 20, 23 and the hydraulic pump 50 and the drain 52, the hydraulic pressures in the low lift side pressure chamber 22 and the high lift side pressure chamber 28 are adjusted. By axially moving or stopping the piston member 57, moreover, the intake camshaft 3 is axially moved or stopped, so that the profile of the cam 4 for driving the intake valve is changed to control the opening/closing timing, the open period and the lift stroke of the intake valve.

The oil passage 30 communicates with the retard pressure chambers 101, 102 and 103 from the communication port 31, the oil pressure chamber 32, an oil passage 33 formed in the intake camshaft 3 and an oil passage 11*a* formed in the bolt 11, via oil passages 111, 112 and 113. The oil passage 35 communicates with the advance pressure chambers 105, 106 and 107 from a not-shown communication port, a not-shown oil pressure chamber and a not-shown oil passage via oil passages 115, 116 and 117.

When the cam 4 drives the intake valve, the cam 4 receives the positive/negative fluctuating torque. These fluctuating torque have an average value on the positive torque side. In other words, the intake camshaft 3 and the vane rotor 63 receive the fluctuating torque acting in the retard direction on average. When the vane rotor 63 is controlled in phase relative to the shoe housing 61, therefore, the advance side pressure chamber requires a higher oil pressure than that of the retard side pressure chamber does. In short, the oil pressure to be applied to the oil passage 35 is higher than that to the oil passage 30.

By controlling the switching valve 54 to change the connections between the oil passages 30, 35 and the hydraulic pump 50 and the drain 52, the hydraulic pressures in the retard side pressure chambers 101, 102 and 103 and the advance side pressure chambers 105, 106 and 107 are adjusted. Accordingly, the angular phase of the vane rotor 63 relative to the timing pulley 60 is adjusted.

When $P_1$ is minimum operating hydraulic pressure necessary for rotating the vane rotor 63, $P_1$ is defined by the following equation (1).

$$P_1 = \frac{2 \times T}{(R_2^2 - R_1^2) \times L \times N} \tag{1}$$

Whereby, T=average torque of the intake camshaft 3, $R_1$=a half of the inside diameter of each of the vanes 63*a,* 63*b* and 63*c,* $R_2$=a half of the outside diameter of each of the vanes 63*a,* 63*b* and 63*c,* L=thickness of each of the vanes 63*a,* 63*b* and 63*c* and N=number of the vanes 63*a,* 63*b* and 63*c*.

In the first embodiment, presuming that the average torque of the intake camshaft 3 is 2.0 N, the half of the inside diameter of each of the vanes 63*a,* 63*b* and 63*c* is ø55 mm, the half of the outside diameter of each of the vanes 63*a,* 63*b* and 63*c* is ø83 mm, the thickness of each of the vanes 63*a,* 63*b* and 63*c* is 27 mm and the number of the vanes 63*a,* 63*b* and 63*c* is three, the minimum operating hydraulic pressure $P_1$ necessary for rotating the vane rotor 63 becomes 51.1 KPa according to the equation (1). Therefore, when the hydraulic pressure in the advance side pressure chambers 105, 106 and 107 is over 51.1 KPa, the vanes 63*a,* 63*b* and 63*c* may rotate in the advance direction against the average torque of the intake camshaft 3.

On the other hand, when $P_2$ is minimum operating hydraulic pressure necessary for axially moving the intake camshaft 3, $P_2$ is defined by the following equation (2).

$$P_2 = F_s / S_H \tag{2}$$

Whereby, $F_S$=thrust force acting on the intake camshaft 3 and $S_H$=axial end face area of the piston member 57 facing the high lift side pressure chamber.

In the first embodiment, presuming that the thrust force of the intake camshaft 3 is 120 N and the axial end face area of the piston member 57 facing the high lift side pressure chamber is 2880 $mm^2$, the minimum operating hydraulic pressure necessary for axially moving the intake camshaft 3 becomes 41.7 KPa according to the equation (2). Therefore, when the hydraulic pressure in the high lift side pressure chamber is over 41.7 KPa, the piston 57 may move in a direction of moving the camshaft toward the higher lift stroke position against the thrust force of the intake camshaft 3.

According to the first embodiment, the minimum operating hydraulic pressure $P_1$ necessary for rotating the vane rotor 63 is arranged to be higher than the minimum operating hydraulic pressure necessary for axially moving the intake camshaft 3, as mentioned above.

Operations of the variable valve control device 1 will now be described.

When the engine is started, that is, before the working oil is introduced from the hydraulic pump 50 into the respective pressure chambers, the vane rotor 63 is at the most retarded position, as shown in FIGS. 1 and 2, relative to the shoe housing 61 as the crankshaft rotates. The top end portion of the stopper piston 65 is fitted in the stopper bore 66*a* by the bias force of the spring 67, so that the vane rotor 63 and the shoe housing 61 are firmly held together. As a result, even if the intake camshaft 3 is subject to the positive/negative torque fluctuations when the intake valve is driven, the movement of the vane rotor 63 in the retard direction and the advance direction relative to the shoe housing 61 is restrained, thereby preventing the relative rotational vibration. Accordingly, the shoe housing 61 and the vane rotor 63 are prevented from colliding and generating chattering noise.

When the intake camshaft 3 receives positive torque fluctuation, the external spline of the positive spline member 15 receives the positive torque backward in the rotational direction because it is contacting against the internal spline 63*d* of the vane rotor 63. When the intake camshaft 3 receives negative torque fluctuation, the external spline of the negative spline member 16 receives the negative torque forward in the rotational direction because it is contacting against the internal spline 63*d*. Accordingly, the collisions of the splines and the generation of the chattering noise are reduced even if the intake camshaft 3 receives the positive/negative torque fluctuations.

When the working oil is not introduced to the low lift side pressure chamber 22 and the high lift side pressure chamber 28, the cam 4 receives the thrust force rightward in FIG. 1 when the intake valve is driven. Accordingly, the intake camshaft 3 moves in the direction as marked in the arrow +X in FIG. 1, that is, toward the lower lift stroke position. It is, therefore, the low lift side profile of the cam 4 that drives the intake valve at the start of the engine.

After the start of the engine, the working oil is supplied from the hydraulic pump 50 to the respective retard side pressure chambers. Since the oil pressure is also applied to the stopper piston 65 via the retard side pressure chamber 101, the stopper piston 65 is disengaged from the stopper bore 66*a* against the bias force of the spring 67 when the oil pressure in the retard side pressure chamber 101 exceeds a predetermined level. This allows the vane rotor 63 to rotate freely relative to the shoe housing 61. Since the vane rotor 63 is held at the most retarded position as shown in FIG. 2, by receiving the hydraulic pressure from the respective retard side pressure chambers, the shoe housing 61 and the vane rotor 63 are prevented from colliding and generating chattering noise even if the intake camshaft 3 receives the positive/negative torque fluctuations at the time of driving the intake valve.

Next, in order to rotate the vane rotor 63 from the most retarded position shown in FIG. 2 toward the advance direction, the switching valve 54 is switched to open the respective retard side pressure chambers to the atmosphere and to supply the working oil to the respective advance side pressure chambers. At this time, the hydraulic pressure is applied to the stopper piston 65 from the advance side pressure chamber 105, so that the stopper piston 65 is kept its disengaged state from the stopper bore 66*a*. When the hydraulic pressure in the respective advance side pressure chambers exceeds the predetermined level, the vane rotor 63 rotates from the most retarded position toward the advance direction while the stopper piston 65 being out of the stopper bore 66*a*, so that the stopper piston 65 and the stopper bore 66*a* are deviated from each other in the circumferential direction, and the stopper piston 65 is located at a position that it is not engaged with the stopper bore 66*a*.

Thereafter, in response to the command from the ECU 53 according to the engine operating conditions, the switching valve 54 is switched to control the hydraulic pressures in the respective retard side pressure chambers and the respective advance side pressure chambers, thereby controlling the angular phase of the vane rotor 63 relative to the shoe housing 61, that is, the angular phase difference between the intake camshaft 3 and the crankshaft. This makes it possible to control the timing for opening/closing the intake valve accurately.

By switching the switching valve 51 according to the engine operating conditions to move the intake camshaft 3 axially, moreover, the opening/closing timing, the opening period and the lifting stroke of the intake valve are controlled. Therefore, more stable engine operation, lower fuel consumption and less exhaust emission may be secured.

Further, when the intake camshaft 3 is at the lowest lift stroke position, the high lift side pressure chamber is hydraulically controlled to the extent that the intake camshaft 3 can not be moved from the lowest lift position to the higher lift stroke position or the hydraulic pressure is applied to the piston member 57 in a manner that a force almost equal to or slightly less than a thrust force of the intake camshaft 3 is given to the piston member 57 in an opposite direction marked by the arrow +X in FIG. 1, that is, in a direction of moving the intake camshaft 3 toward the higher lift stroke position. Therefore, even if the intake camshaft 3 is kept at the lowest lift stroke position, the friction between the piston member 57 and the annular portion 55*b* is minimized, thus resulting in the better responsiveness of the angular phase control for the intake camshaft 3.

On the other hand, when the intake camshaft 3 is at the highest lift stroke position, the low lift side pressure chamber is hydraulically controlled to the extent that the intake camshaft 3 can not be moved from the highest lift position to the lower lift stroke position. Therefore, even if the intake camshaft 3 is kept at the highest lift stroke position, the friction between the piston member 57 and the rear plate 62 is minimized, thus resulting in the better responsiveness of the angular phase control for the intake camshaft 3.

In the first embodiment, the angular phase control of the vane rotor 63 relative to the shoe housing 61 and the axial movement control of the camshaft 3 via the piston member 57 can be independently carried out by controlling the respective switching valves 51 and 54, separately.

Further, as the minimum operating hydraulic pressure necessary for rotating the vane rotor 63 is higher than the minimum operating hydraulic pressure necessary for axially moving the intake camshaft 3, the piston member 57 is always ready to be axially movable at the time when the angular phase of the intake camshaft 3 is actually changed. Therefore, when the intake camshaft 3 is at the lowest lift stroke position, the intake camshaft 3 may be easily shifted via the piston member 57 from the lowest lift stroke position to the higher lift stroke position without time delay so that a highly accurate angular phase control of the intake camshaft may be secured, while a better responsiveness of the angular phase control of the intake camshaft 3 may be also assured.

Furthermore, even when the intake camshaft 3 is at the lowest lift stroke position or at the highest lift stroke position, at least the high lift side pressure chamber or the low lift side pressure chamber is hydraulically controlled to the extent that the intake camshaft 3 can not be moved from the lowest lift position to the higher lift stroke position or from the highest lift stroke position to the lower lift stroke position. Therefore, a better responsiveness of the angular phase control of the intake camshaft 3 may be also assured. As the hydraulic pressure difference necessary for axially shifting the piston member 57 from the lowest lift stroke position to the higher lift stroke position or from the highest lift stroke position to the lower lift stroke position is relatively small or, preferably, near zero, a better responsiveness of the axial movement control may be secured, that is, when the valve-open period and the lift stroke is held at a point, a better responsiveness of changing the valve-open period and the lift stroke from the point to another point may be assured.

Furthermore, since the axial position of the piston member 57 is always controlled by the pressure difference between the high lift side pressure chamber 28 and the low lift side pressure chamber 22 and both pressure chambers are filed with oil, air invasion into the high lift side pressure chamber 28 and the low lift side pressure chamber 22 can be prevented so that a much better responsiveness of the axial movement control of the intake camshaft 3 from the lowest lift stroke position to the higher lift stroke position or from the highest lift stroke position to the lower lift stroke position may be secured.

In addition, the positive spline member 15 and the negative spline member 16 are so circumferentially positioned and mounted on the intake camshaft 3 not to rotate relative to the intake camshaft 3 that their external spline may contact against the internal spline 63*d* of the vane rotor 63 forward and backward of the rotational direction and the same direction with the deviated tooth traces to establish no backlash. Even if the intake camshaft 3 receives the positive/negative torque fluctuations, therefore, the chattering noise, as might otherwise be generated by the collisions between the splines, can be prevented at the spline portion between the vane rotor 63 and the positive/negative spline members 75 and 76.

The angular phase control means and the axial movement control means of the intake camshaft 3 are constructed as one assembly at one end portion of the intake camshaft 3. Therefore, the variable valve control device according to the first embodiment may be constituted by less number of components with less assembly works and, thus, becomes compact as a whole so that the manufacturing cost may be minimized.

Furthermore, there is adopted the construction in which the torque of the crankshaft is transmitted by the timing pulley 60 to the intake camshaft 3 and the exhaust camshaft 5. The construction can be modified by using a chain sprocket or a timing gear. Another modification may be such that the torque of the crankshaft acting as the drive shaft is received by the vane rotor to rotate the intake camshaft and the shoe housing integrally.

In the first embodiment, the angular phase of the intake camshaft 3 is adjusted relative to the timing pulley and the angular phase of the exhaust camshaft 4 is equal to that of the timing pulley. However, it may be possible to modify such that the angular phase of the exhaust camshaft 4 is adjusted relative to the timing pulley and the angular phase of the intake camshaft 3 is equal to that of the timing pulley. In this case, the intake camshaft 3 changes places with the exhaust camshaft 4 and the torque of the crankshaft is transmitted to the intake camshaft 3 from the exhaust camshaft 4. Further, the torque from the rotating member to the exhaust camshaft may be transmitted by not only the gear but also a chain or a belt.

Though the intake camshaft 3 drives the intake valve and the exhaust camshaft 4 drives the exhaust valve in the first embodiment, a camshaft may drive both the intake and exhaust valves.

Second Embodiment

Figure 4:
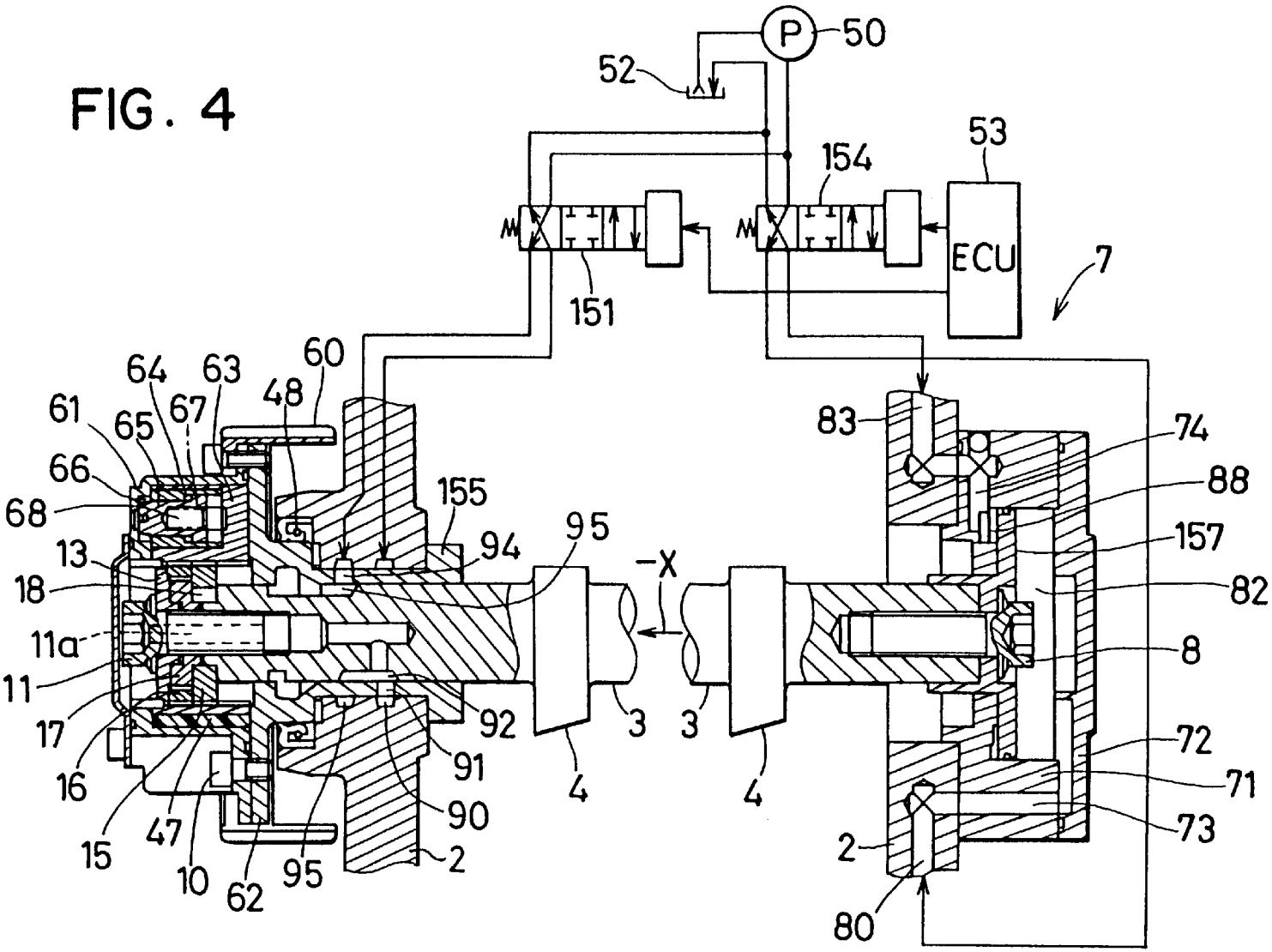
FIG. 4 is a cross sectional view of a variable valve control device according to a second embodiment of the present invention.

A second embodiment of the present invention, in which the axial movement control means similar to that of the first embodiment is provided at another axial end of the intake camshaft 3 separately from the angular phase control means, is described in reference with FIG. 4. Parts and components substantially similar to those of the first embodiment have the same reference numbers.

In the second embodiment, the angular phase control means is arranged at an axial end of the intake camshaft 3 and the axial movement control means is arranged at the other axial end of the intake camshaft 3, as shown in FIG. 4. According to a variable valve control device 7 of the second embodiment, a piston member 157 as axial moving means is housed in the cylinder head 2 at the other axial end of the intake camshaft 3 and is assembled to an axial end of the intake camshaft 3 by a bolt 8 in a manner that the piston member 157 can neither rotate nor axially move relative to the camshaft 3. The piston member 157 divides the hydraulic pressure chamber, defined by cylinder head members 71 and 72 of the cylinder head 2, into a low lift side pressure chamber 82 and a high lift side pressure chamber 88. The camshaft 3 in FIG. 4 is at the lowest lift stroke position.

Annular oil passages 90 and 95 are formed in the inner circumferential wall of the cylinder head 2 on an end side of the intake camshaft 3 and oil passages 80 and 83 are formed in the cylinder head 2 on the other end side of the intake camshaft 3. These oil passages 90 and 95 can be connected to either of a hydraulic pump 50 acting as a drive source or a drain 52 via a switching valve 151. On the other hand, the oil passages 80 and 83 can be connected to either of the hydraulic pump 50 acting as the drive source or the drain 52 via a switching valve 154. The switching valves 151 and 154 can independently switch the oil passages in response to a command from the ECU 53. Communication ports 91 and 94 are formed in a rotary member 155. In the outer circumferential wall of the intake camshaft 3, there are formed oil pressure chambers 92 and 95 that have arc-shaped transverse cross sections.

The oil passage 80 communicates with the low lift side pressure chamber 82 via the oil passage 73 formed inside the cylinder head member 71. The oil passage 83 communicates with the high lift side pressure chamber 88 via the oil passage 74 formed in the cylinder head member 71.

When the cam 4 drives the intake valve, the intake camshaft 3 receives the thrust force leftward in FIG. 4, that is, in a −X direction shown by an arrow in FIG. 3. Therefore, when the piston member 157 is controlled to move axially against the thrust force, the high lift side pressure chamber 88 requires a higher hydraulic pressure than that of the low lift side pressure chamber 82 does. By controlling the switching valve 154 to change the connections between the oil passages 80, 83 and the hydraulic pump 50 and the drain 52, the hydraulic pressures in the low lift side pressure chamber 82 and the high lift side pressure chamber 88 are adjusted. By axially moving or stopping the piston member 157, moreover, the intake camshaft 3 is axially moved or stopped, so that the profile of the cam 4 for driving the intake valve is changed to control the opening/closing timing, the open period and the lift stroke of the intake valve.

According to the second embodiment, as the minimum operating hydraulic pressure necessary for rotating the vane rotor 63 is arranged to be higher than the minimum operating hydraulic pressure necessary for axially moving the piston, member 157, the piston member 157 is always ready to be axially movable at the time when the angular phase of the intake camshaft 3 is actually changed. Therefore, when the intake camshaft 3 is at the lowest lift stroke position, the intake camshaft 3 may be easily shifted via the piston member 157 from the lowest lift stroke position to the higher lift stroke position without time delay so that a highly accurate angular phase control of the intake camshaft 3 relative to the timing pulley 60 may be secured, while a better responsiveness of the angular phase control of the intake camshaft 3 may be also assured. According to the second embodiment, when the intake camshaft 3 is at the lowest lift stroke position, the high lift side pressure chamber is hydraulically controlled to the extent that the intake camshaft 3 can not be moved from the lowest lift position to the higher lift stroke position or the hydraulic pressure is applied to the piston member 157 against the thrust force acting in the lower lift stroke position, that is, in a direction marked by the arrow –X in FIG. 4 in a manner that a force almost equal to and slightly less than a thrust force of the intake camshaft 3 is given to the piston member 157 in a direction of moving the intake camshaft 3 toward the higher lift stroke position. Therefore, even if the intake camshaft 3 is kept at the lowest lift stroke position, the friction between the piston member 157 and the cylinder head member 71 is minimized, thus resulting in the better responsiveness of the angular phase control for the intake camshaft 3.

On the other hand, according to the second embodiment, when the intake camshaft 3 is at the highest lift stroke position, the low lift side pressure chamber is hydraulically controlled to the extent that the intake camshaft 3 can not be moved from the highest lift position to the lower lift stroke position. Therefore, even if the intake camshaft 3 is kept at the highest lift stroke position, the friction between the piston member 157 and the cylinder head member 72 is minimized, thus resulting in the better responsiveness of the angular phase control for the intake camshaft 3.

Further, even when the intake camshaft 3 is at the lowest lift stroke position or at the highest lift stroke position, at least the high lift side pressure chamber or the low lift side pressure chamber is hydraulically controlled to the extent that the intake camshaft 3 can not be moved from the lowest lift position to the higher lift stroke position or from the highest lift stroke position to the lower lift stroke position. As the hydraulic pressure difference necessary for axially shifting the piston member 157 from the lowest lift stroke position to the higher lift stroke position or from the highest lift stroke position to the lower lift stroke position is relatively small or, preferably, near zero, a better responsiveness of the axial movement control may be secured, that is, when the valve-open period and the lift stroke is held at a point, a better responsiveness of changing the valve-open period and the lift stroke from the point to another point may be assured. Furthermore, since the axial position of the piston member 157 is always controlled by the pressure difference between the high lift side pressure chamber 88 and the low lift side pressure chamber 82 and both pressure chambers are filed with oil, air invasion into the high lift side pressure chamber 88 and the low lift side pressure chamber 82 can be prevented so that a much better responsiveness of the axial movement control of the intake camshaft 3 from the lowest lift stroke position to the higher lift stroke position or from the highest lift stroke position to the lower lift stroke position may be secured. According to the first and second embodiments mentioned above, it is arranged that hydraulic pressure more than minimum operating pressure necessary for axially moving the piston member 57, 157 is always ready to be applied to the axial movement control member at the time when the angular phase control means actually changes the angular phase of the intake camshaft 3 relative to the drive shaft. In particular, the minimum operating hydraulic pressure necessary for controlling the vane rotor 63 is arranged to be higher than that for axially moving the piston member 57, 157. As a result, whenever the angular phase is actually changed, the hydraulic pressure sufficient enough to move the piston member 57, 157 may be always ready to be applied to the axial movement control member. Therefore, when the intake camshaft 3 is at the lowest lift stroke position, the intake camshaft 3 may be easily shifted from the lowest lift stroke position to the higher lift stroke position without time delay so that a highly accurate angular phase control of the intake camshaft relative to the timing pulley 60 may be secured.

The positive and negative spline members 15 and 16 may be engaged with the vane rotor 63 via helical spline in place of the straight spline as mentioned in the above embodiments.

Although the present invention has been described in connection with the preferred embodiment thereof with reference to the accompanying drawings, it is to be noted that various changes and modifications will be apparent to those skilled in the art. Such changes and modifications are to be understood as being included within the scope of the present invention as defined in the appended claims.

What is claimed is:

1. A variable valve control device for an internal combustion engine having an intake valve, an exhaust valve and a drive shaft, comprising:

a rotatable and axially movable driven shaft provided with a cam having axially and radially different profile for opening and closing at least one of the intake valve and the exhaust valve, opening/closing timing of the valve being variable by adjusting angular phase of the driven shaft relative to the drive shaft and lift stroke of the valve being variable by adjusting axial position of the driven shaft;

Angular phase control means having a drive side rotor rotating in synchronism with the drive shaft and a driven side rotor rotating together with the driven shaft but allowing the axial movement of the driven shaft, an angular phase of the driven side rotor relative to the drive side rotor being hydraulically controlled; and axial movement control means having a pressure chamber and a piston fixed with the driven shaft and axially moving in the pressure chamber, an axial movement of the piston is hydraulically controlled, wherein the angular phase control means and the axial movement control means are basically operative independently of each other but hydraulic pressure more than minimum operating pressure for axially moving the piston is always ready to be applied to the axial movement control means at the time when the angular phase control means actually changes the angular phase of the driven side rotor relative to the drive side rotor.

2. A variable valve control device as in claim 1, wherein the axial movement control means and the angular phase control means have a feature that the minimum operating hydraulic pressure to the angular phase control means necessary for changing the angular phase of the driven side rotor is higher than that to the axial movement control means for axially moving the piston.

3. A variable valve control device as in claim 1, wherein, when the piston is positioned at an axial movable end in the pressure chamber, the pressure chamber is hydraulically controlled so as to give to the piston force acting toward another axially movable end in the pressure chamber to the extent that the force is not so large to actually move the piston toward the another axially movable end.

4. A variable valve control device as in claim 1, wherein, when the piston is positioned at an axially movable end in the pressure chamber and receives thrust force in a direction of being pressed onto the axially movable end, the thrust force being exerted in the driven shaft due to the contact of the cam with the valve, the pressure chamber is hydraulically controlled so as to give to the piston force acting toward the another axially moving end and being nearly equal to the thrust force.

* * * * *

UNITED STATES PATENT AND TRADEMARK OFFICE

CERTIFICATE OF CORRECTION

PATENT NO. : 6,182,623
DATED : February 6, 2001
INVENTOR(S) : SUGIE et al

It is certified that error appears in the above-identified patent and that said letters patent is hereby corrected as shown below:

In the title sheet, the assignee information should appear as follows:

(73) Assignee: Denso Corporation, Kariya (JP)
Toyota Jidosha Kabushiki Kaisha, Toyota (JP)

Signed and Sealed this

Twenty-ninth Day of May, 2001

*Attest:*

NICHOLAS P. GODICI

*Attesting Officer*

*Acting Director of the United States Patent and Trademark Office*